US005100266A

United States Patent [19]

Ushitora et al.

[11] Patent Number: 5,100,266

[45] Date of Patent: Mar. 31, 1992

[54] PIPE CONNECTION STRUCTURE AND VACUUM-TYPE SEWAGE COLLECTING APPARATUS INCORPORATING THE PIPE CONNECTION STRUCTURE

[75] Inventors: Akihiro Ushitora, Kanagawa; Kazuo Yamaguchi, Tokyo; Tsuneo Asanagi, Kanagawa, all of Japan

[73] Assignee: Ebara Corporation, Tokyo, Japan

[21] Appl. No.: 574,197

[22] Filed: Aug. 29, 1990

[30] Foreign Application Priority Data

Aug. 31, 1989 [JP] Japan ..... 1-225837

[51] Int. Cl.[5] ..... B65G 53/52

[52] U.S. Cl. ..... 406/120; 406/151; 406/191; 137/236.1; 4/321

[58] Field of Search ..... 406/108, 120, 151, 191; 137/205, 236.1; 4/316, 321, 323, 431

[56] References Cited

U.S. PATENT DOCUMENTS 3,239,849 3/1966 Liljendahl ..... 4/345
3,730,884 5/1973 Burns ..... 406/19

FOREIGN PATENT DOCUMENTS 802017 8/1936 France .
825010 2/1938 France .
2017188 10/1979 United Kingdom .

*Primary Examiner*—Margaret A. Focarino

*Assistant Examiner*—Andrew C. Pike

*Attorney, Agent, or Firm*—Wenderoth, Lind & Ponack

[57] ABSTRACT

A vacuum-type sewage collecting apparatus collect sewage discharged from a plurality of houses or facilities in an accumulating tank through a vacuum sewage pipe network, the inner pressure of which is negative. The vacuum sewage pipe network includes a plurality of upper stream pipes and lower stream pipes fastened to each other in a branch-like fashion. Each lower stream pipe has a sawtooth-like shape formed by alternately disposed downwardly-sloping portions extending gently downwards toward said accumulating tank, and lift portions fastened to the lowermost portion of a respective downwardly-sloping portion and extending upwardly with a steep slope. The upper stream pipe is connected to the lower stream pipe in a range in which a horizontal plane, which extends through an upper end portion of the lower stream pipe at the position in which the downwardly-sloping portion adjoins the lift portion, is higher than the center of the lower stream pipe. The upper stream pipe opens to the lower stream pipe at a position diagonally above the center of the lower stream pipe as viewed in a plane perpendicular to the pipe central axis. At least a portion of the opening is higher than the horizontal plane, and the upper stream pipe extends from the lower stream pipe diagonally upwards.

12 Claims, 5 Drawing Sheets

PIPE CONNECTION STRUCTURE AND VACUUM-TYPE SEWAGE COLLECTING APPARATUS INCORPORATING THE PIPE CONNECTION STRUCTURE

BACKGROUND OF THE INVENTION

1. Field of the Art

The present invention relates to a pipe connection structure and a vacuum-type sewage collecting apparatus incorporating the pipe connection structure.

2. Prior Art

Hitherto, a vacuum-type sewage collecting apparatus has been known as an apparatus for collecting sewage from a plurality of houses or facilities.

FIG. 4 illustrates the overall structure of a conventional vacuum-type sewage collecting apparatus of the type described above.

As shown in the drawing, sewage discharged from each of houses 30 on the ground passes under natural flow through sewage pipes 31 disposed underground until it flows into cesspools 32 disposed more deeply underground. When a predetermined quantity of the sewage accumulates in an underground cesspool 32, a vacuum valve 33 provided in the upper portion of the inside of the cesspool 32 is opened so that sewage accumulated in the cesspool 32 is sucked through a suction pipe 34.

The sewage sucked through the vacuum valve 33 via suction pipe 34 is introduced into a vacuum sewage pipe 1 arranged underground. Then, it is accumulated in an accumulating tank 41 in a vacuum pump plant 40.

The sewage accumulated in the accumulating tank 41 is then sent to a sewage treatment plant or the like by a feeding pump 42. A vacuum pump 43 is connected to the accumulating tank 41 to create negative pressure in the accumulating tank 41 and the vacuum sewage pipe 1.

FIG. 5 is a schematic view which illustrates a network of vacuum sewage pipes 1 for use in a vacuum-type sewage accumulating apparatus of the type described above.

As shown in the drawing, one or a plurality of main pipes 1-1 are connected to the accumulating tank 41. Furthermore, a plurality of branch pipes 1-2 are connected to the main pipe 1-1. In addition, lateral pipes 1-3, to which the vacuum valves 33 are connected, are connected to the main pipes 1-1 or the branch pipes 1-2. The pipes are thus branched from one another underground.

FIG. 6 is a side elevational view which illustrates the shape of the main pipe 1-1 or branch pipes 1-2 constituting the vacuum sewage pipe 1 embedded underground.

As shown in the drawing, the main pipe 1-1 or the branch pipe 1-2 includes downward-slope portions 11 which extend downwardly towards the accumulating rank 41 in the vacuum pump plant 40 and a lift portion 12 fastened to the lowermost portion of a downward-slope portion 11. The lift portion 12 has a steep upward slope of about 45°. These downward-slope portions 11 and the lift portions 12 are provided alternately so as to exhibit a sawtooth-shaped configuration.

The reason for the provision of the lift portion 12 lies in that if the vacuum sewage pipe is constituted only by the downward-slope portions 11, the underground depth of the pipes becomes too deep.

The sewage, which has passed through the downward-slope portion 11, clears the lift portion 12 by the effect of the negative pressure supplied from the accumulating tank 41 and again passes through the next downward-slope portion 11. As a result, the sewage flows to the accumulating tank 41.

FIG. 7 illustrates a conventional structure for establishing a connection between the main pipe 1-1 and the branch pipe 1-2.

As shown in the drawing, hitherto, the branch pipe 1-2 has been connected to just the upper portion of the main pipe 1-1.

If the branch pipe 1-2 is fastened to just the side of the main pipe 1-1 as shown in FIG. 8, an opening 16 at which the branch pipe 1-2 communicates with the main pipe 1-2 may become clogged with sewage. This leads to a fact that air a in the main pipe 1-1 and air b in the branch pipe 1-2 are separated from each other, causing a backward flow of the sewage in the main pipe 1-1 toward the branch pipe 1-2 if the pressure of air b becomes lower than that of air a. Therefore, the branch pipe 1-2 is instead fastened to the upper portion of the main pipe 1-1 as shown in FIG. 7.

Since the above-described problem would otherwise occur in the junction between the main pipe 1-1 and the branch pipe 1-2, the junction between the main pipe 1-1 and the lateral 1-3, and the junction between the branch pipe 1-2 and the lateral 1-3, a similar connection structure is employed for each of the above-described branched portions.

However, in the case where the branch pipe is connected to the upper portion of the main pipe, the following problems arise.

(1) Problem in Terms of Strength

As shown in FIG. 7, if the branch pipe 1-2 is fastened to the upper portion of the main pipe 1-1, the distance m between the bottom of the main pipe 1-1 and the bottom of the branch pipe 1-2 is excessively large. Therefore, when the thus connected main pipe 1-1 and the branch pipes 1-2 are laid underground, the level n of portion g of the branch pipe 1-2 adjacent to the junction thereof with the main pipe 1-1 is considerably high from the bottom of a groove 35, which was excavated to the depth l to accommodate the main pipe 1-1.

As a result, the branch pipe 1-2 is laid on soft and thick earth placed to recover the groove 35. However, the recovering earth is too soft to support the branch pipe 2 at its lower side. Therefore, when the load from ground level and the weight of the recovering earth above the branch pipe 1-2 are applied thereto, the portion g of the pipe 1-2 receives an excessive load. As a result, a problem arises in that the branch pipe 1-2 may be easily broken. The above-described problem becomes critical in the case where the vacuum sewage pipe is embedded under the ground on which vehicles or the like run.

(2) Problem in Terms of the Depth of the Pipe

In general, when a vacuum sewage pipe is laid underground, it must be placed at a certain depth in order to disperse the load from ground level applied to the vacuum sewage pipe. Furthermore, in cold areas, it must be laid at a considerable depth so as to prevent it from freezing.

However, as shown in FIG. 7, if the branch pipe 1-2 is fastened to just the upper portion of the main pipe 1-1, the position of the branch pipe 1-2 becomes considerably high relative to the main pipe 1-2. Therefore, in order to lay the branch pipe 1-2 at a predetermined depth, the main pipe 1-1 must be laid at a greater depth.

As a result, the excavating work is difficult, resulting in an undesirable raising of costs.

SUMMARY OF THE INVENTION

Therefore, an object of the present invention is to provide a pipe connection for use in a vacuum-type sewage collecting apparatus which is free of the above-mentioned problems.

Another object of the present invention is to provide a vacuum-type sewage collecting apparatus which is free of the above-described problems by incorporating the above pipe connection structure.

In order to accomplish the above-described objects, the present invention is applied to a vacuum-type sewage collecting apparatus for collecting sewage discharged from a plurality of houses or facilities in an accumulating tank through a vacuum sewage pipe network, the inner pressure of which has been made negative. The vacuum sewage pipe network includes a plurality of upper stream pipes and lower stream pipes fastened to each other in a branched fashion, each lower stream pipe having a sawtooth-like shape formed by alternately disposed downward-slope portions, extending gently downwards toward the accumulating tank, and lift portions adjoining the lowermost portion of the downward-slope portion and extending upwardly with a steep slope. The invention resides in that the upper stream pipe is connected to the lower stream pipe in a range in which a horizontal plane, which extends through an upper end portion of the lower stream pipe at a location at which the downward-slope portion adjoins the lift portion, is higher than the center of the lower stream pipe, in that the upper stream pipe is open to the lower stream pipe at a location diagonally upward from the center of the lower stream pipe as viewed in a plane perpendicular to the pipe central axis, in that at least a portion of the opening is higher than the horizontal plane, and in that the upper stream pipe extends diagonally upwards from the lower stream pipe.

As described above, since the upper stream pipe is connected to a diagonally upper portion of the lower stream pipe so as to extend diagonally upwards therefrom, the level difference between the two pipes can be reduced.

In addition, since at least a portion of the opening of the upper stream pipe is positioned above the above-described horizontal plane, the air in the lower stream pipe and the air in the upper stream pipe can always communicate with each other. Therefore, a backward flow of sewage from the lower stream pipe toward the upper stream pipe can be prevented.

The above and other objects, features and advantages of the present invention will become more apparent from the following description when taken in conjunction with the accompanying drawings in which a preferred embodiment of the present invention is shown by way of illustrative examples.

DETAILED DESCRIPTION OF THE PREFERRED EMBODIMENT

A preferred embodiment of the present invention will now be described with reference to the drawings.

Figure 1:
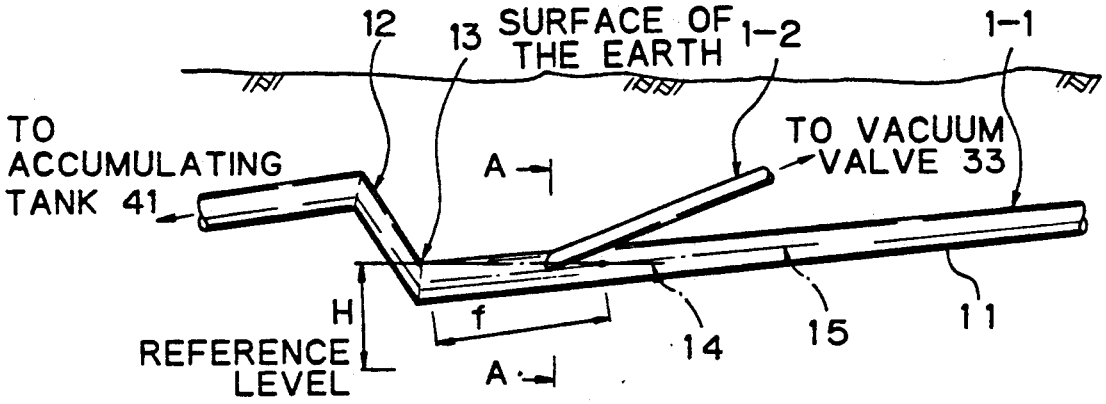
FIG. 1 is a diagram of a branch pipe connected to a main pipe according to the present invention.
Figure 2:
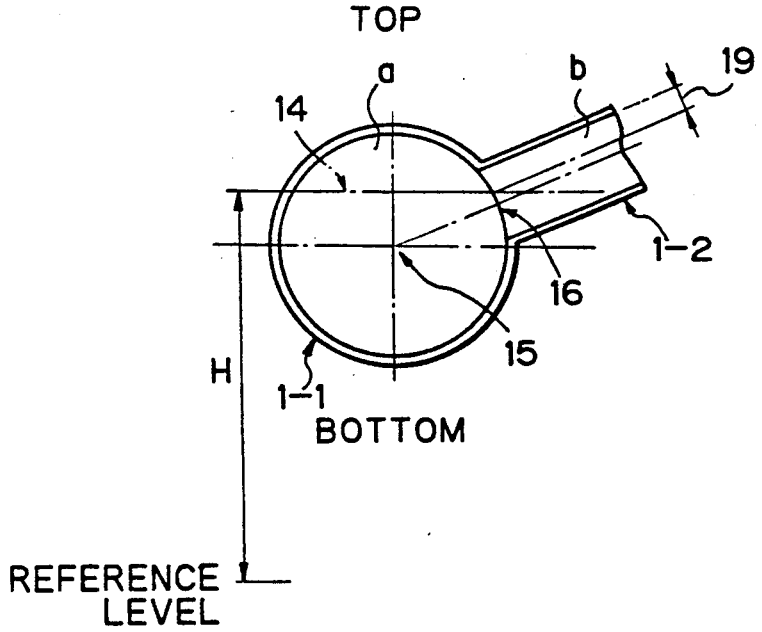
FIG. 2 is a side elevational cross-sectional view of the main pipe and the branch pipe taken along line A—A of FIG. 1.

FIG. 1 illustrates the manner in which the branch pipe 1-2 is connected to the main pipe 1-1 according to the present invention. FIG. 2 is a side elevational cross-sectional view of the main pipe 1-1 and the branch pipe 1-2 taken along line A—A of FIG. 1.

As shown in FIG. 1, the main pipe 1-1 comprises a gentle downward-slope portion 11 and a steep upward-slope lift portion 12 which are alternately provided upstream of the location at which the main pipe 1-1 is connected to the accumulating tank 41.

The branch pipe 1-2 is connected to the main pipe 1-1 at a position adjacent to the location at which lift portion 12 extends from the downward-slope portion 11, and at a diagonally upper portion of the main pipe 1-1.

This connection will next be described in detail.

The branch pipe 1-2 is connected to the main pipe 1-1, as shown in FIG. 1, within a lengthwise range f in which a horizontal plane 14 is higher than the center 15 of the main pipe 1-1, the horizontal plane 14 passing through an upper end portion 13 of the main pipe at a location at which the downward-slope portion 11 adjoins the lift portion 12.

As shown in FIG. 2, the branch pipe 1-2 is connected to the main pipe 1-1 in such a manner that its opening 16 opens at a position diagonally above the central axis 15 of the main pipe 1-1 in a plane perpendicular to the central axis 15. Furthermore, at least a portion 19 of the opening 16 at which the branch pipe 1-2 is open to the main pipe 1-1 is higher than the above-described horizontal plane 14.

Next, the flow of sewage in the case where the branch pipe 1-2 is connected as described above will be described.

Figure 3:
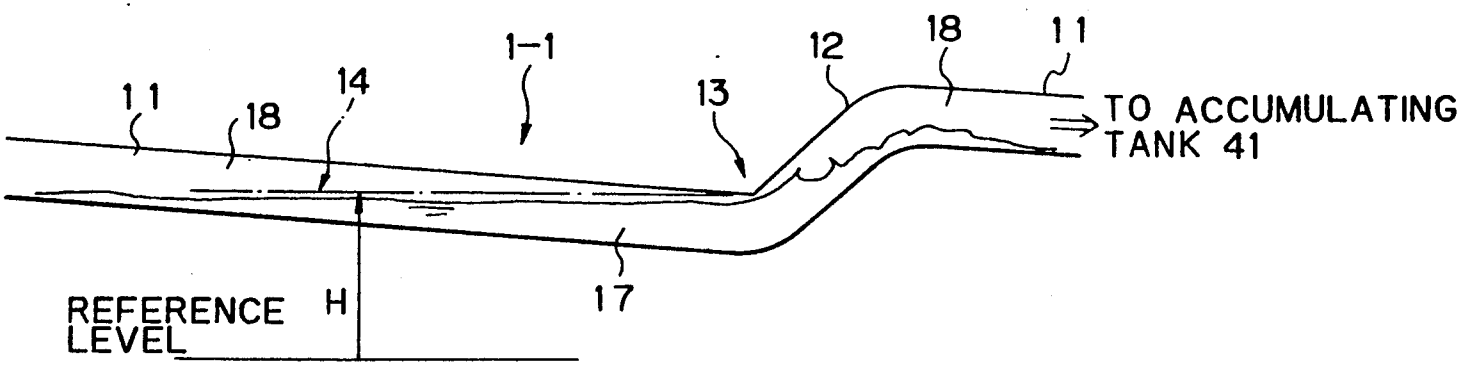
FIG. 3 is a schematic diagram of the junction between the downward-slope portion and the upward lift portion illustrating the state of flow of sewage therethrough.
Figure 4:
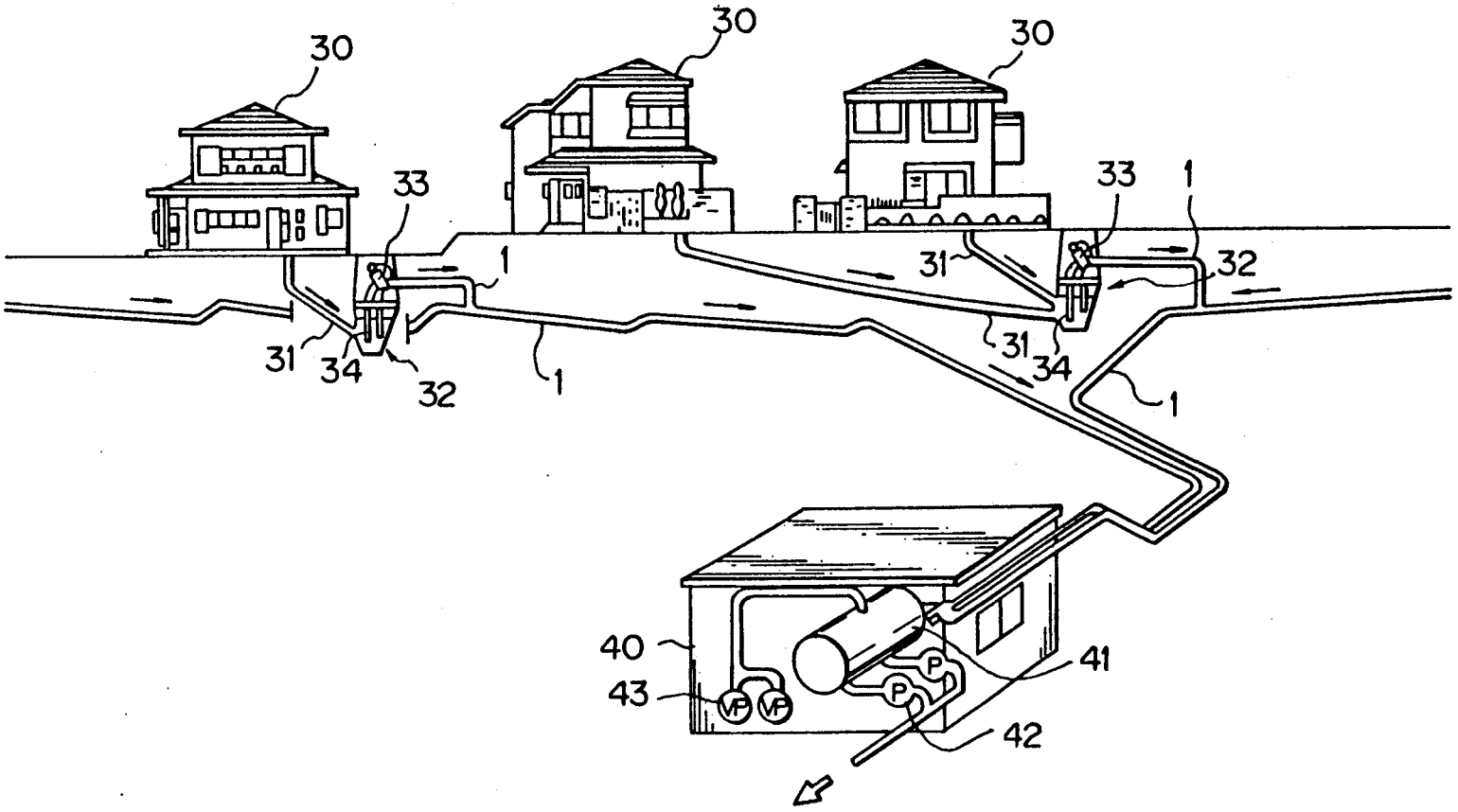
FIG. 4 is a schematic diagram of the overall structure of a conventional vacuum-type sewage collecting apparatus.
Figure 5:
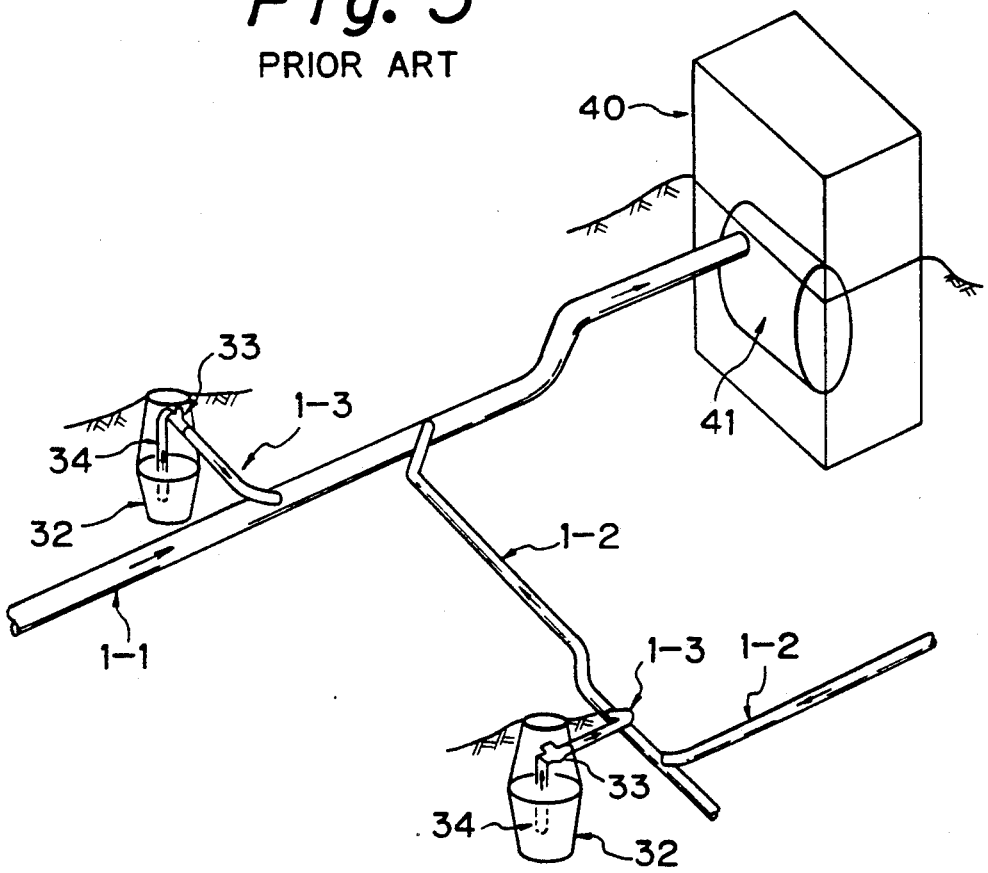
Fig. 5 PRIOR ART
FIG. 5 is a schematic diagram of a vacuum sewage pipe in the conventional vacuum-type sewage collecting apparatus.
Figure 6:
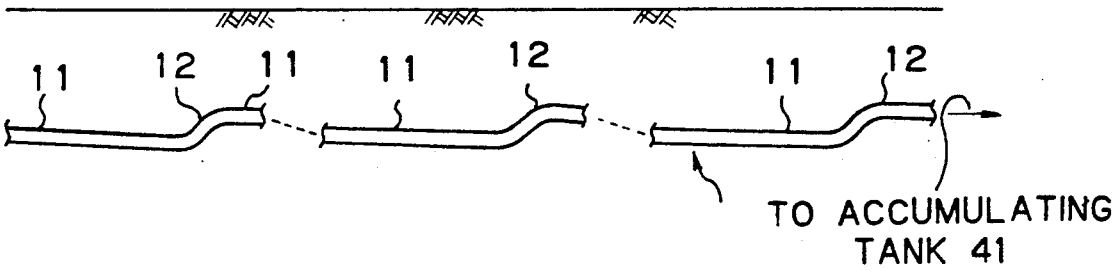
Fig. 6 PRIOR ART
FIG. 6 is a side elevational view of the main pipe and the branch pipe which constitute the vacuum sewage pipe.
Figure 7:
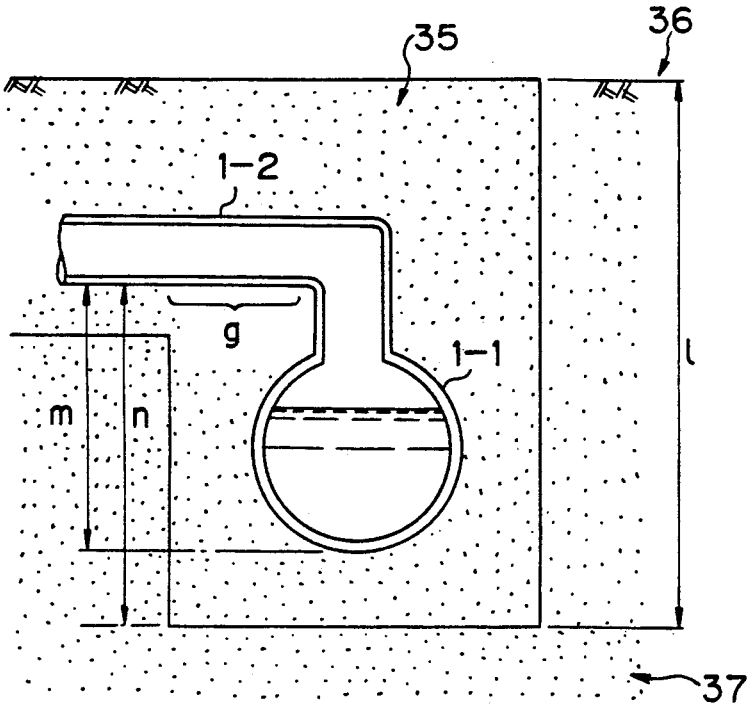
Fig. 7 PRIOR ART
FIGS. 7 and 8 are side elevational cross-sectional views, respectively, of conventional connections between the main pipe and the branch pipe.

FIG. 3 illustrates the state of the flow of sewage 17 in the vicinity of the junction of the downward-slope portion 11 and the lift portion 12.

As shown in the drawing, the sewage 17 which has been dragged by air 18 and has flowed into the gentle downward-slope portion 11 is accumulated in its deepest portion. Since air 18 and sewage 17 successively flow to the deepest portion from the upper stream side, the excessive quantity of the sewage 17 in the deepest portion clears the lift portion 12 due to the force of the air 18 so as to flow forwards. Then, the sewage 17 again slowly flows through the next downward-slope portion 11. In this manner, the sewage 17 is introduced into the accumulating tank 41.

The inventor of the present invention carefully observed the state of movement of the sewage 17 from the downward-slope portion 11 to the lift portion 12. As a result, it has been found that, although the sewage 17 accumulates in the deepest portion of the downward-slope portion 11, it does not exceed the level of the horizontal plane 14 which extends through the uppermost portion 13 of the pipe at the location at which the downward-slope portion 11 adjoins the lift portion 12. The reason for this lies in that the level of the negative pressure of air 18 in the right side (lower stream side near the accumulating tank 41) when viewed in the drawing becomes higher than that of air 18 in the left side (upper stream side near the vacuum valve 33) when the sewage comes in contact with the upper end portion 13. As a result, the sewage 17 is blown up so as to rise above the lift portion 12.

According to these embodiments, as shown in FIG. 2, since the branch pipe 1-2 is connected in such a manner that at least a portion of the opening 16 of the branch pipe 1-2 is positioned above the horizontal plane 14, air a in the main pipe 1-1 and air b in the branch pipe 1-2 are not separated from each other by the sewage 17. Therefore, even if the pressure level of the air a becomes higher than that of air b, air a only moves toward the branch pipe 1-2. Therefore, the sewage 17 in the main pipe 1-1 does not flow back toward the branch pipe 1-2.

As described above, the branch pipe 1-2 may be fastened in such a manner that at least a portion of its opening 16 is positioned above the horizontal plane 14. According to the experiment carried out by the inventor of the present invention, the effect of the present invention can be significantly exhibited when 10% to 50% of the area of the opening 16 of the branch pipe 1-2 is positioned above the above-described horizontal plane 14.

That is, if 10% or more of the area of the opening 16 is above the horizontal plane 14, the quantity of air moving between the main pipe 1-1 and the branch pipe 1-2 becomes sufficient to completely prevent the backward flow of the sewage 17.

If 50% or more of the area of the opening 16 is positioned above the horizontal plane 14 within the pipe connection range f, the junction at which the branch pipe 1-2 is connected to the main pipe 1-1 is located considerably upwards, causing a similar problem to that which takes place in the conventional structure in which the branch pipe 1-2 is fastened to the upper portion of the main pipe 1-1.

Figure 8:
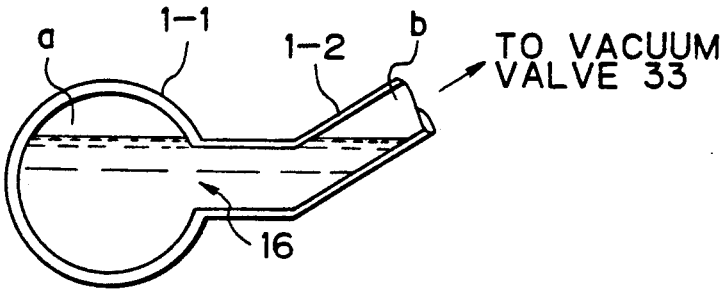
Fig. 8 PRIOR ART

According to the above-described embodiment, the pipe connection range is limited to the range f in which the horizontal plane 14 is higher than the center 15 of the main pipe 1-1. The reason for this arrangement lies in that the sewage 17 does not occupy that portion of the main pipe 1-1 in the range where the horizontal plane 14 is lower than the pipe center 15. Therefore, even if the branch pipe 1-2 is connected to the side of that portion of the main pipe 1-1 as shown in FIG. 8, such junction is not clogged by sewage.

The clogging problem would arise when the branch pipe 1-2 is connected to the main pipe 1-1 within the pipe connection range f, but the subject invention can avoid such clogging even when the pipe connection is made within the connection range f.

According to the above-described embodiment, a connection of the main pipe 1-1 to the branch pipe 1-2 is described. The present invention is not limited to this but may be applied, of course, to a case in which the branch pipe 1-2 is connected to another branch pipe 1-2 and to a case in which the lateral 1-3 is connected to the main pipe 1-1 or to the branch pipe 1-2. That is, the present invention is applicable to any case in which an upper stream pipe (that is, the branch pipe 1-2 or the lateral 1-3) is connected to a lower stream pipe (that is, the main pipe 1-1 or the branch pipe 1-2) in which the downward-slope portion 11 and the lift portion 12 are alternately provided.

As described above, according to the present invention, the upper stream pipe (branch pipe or lateral pipe) is connected to the lower stream pipe (the main pipe or the branch pipe) at a diagonally upper portion thereof and extends therefrom at an upward slope. Therefore, the difference in level between the two pipes is comparatively small.

As a result, the distance between the bottom of the upper stream pipe laid in the groove and the bottom of the groove is also comparatively small. Therefore, even if a downward load is applied on the upper stream pipe, it is positively supported by the earth below the groove. As a result, the upper stream pipe is protected from being damaged. Furthermore, the necessity of excavating a deep groove is eliminated.

Also according to the present invention, the air in the upper stream pipe always communicates with the air in the lower stream pipe. Therefore, a backward flow of sewage from the lower stream pipe to the upper stream pipe can be prevented.

We claim:

1. An underground vacuum pipe network of a vacuum-type sewage collecting apparatus, said network comprising:

a plurality of lower stream pipes each including alternately disposed downwardly-sloping portions extending gently downwards and lift portions extending with a steep upward slope from lowermost parts of said downwardly-sloping portions, respectively, wherein the lower stream pipes extend along a sawtooth-like path, and a plurality of upper stream pipes branching from said lower stream pipes, each of the upper stream pipes extending from a respective one of said lower stream pipes within a range over which a horizontal plane, which extends through an upper portion of the respective one of said lower stream pipe at a location at which one of the downwardly-sloping portions thereof adjoins one of the lift portions, is higher than a central longitudinal axis of the respectively one of said lower stream pipes, each of the upper stream pipes being open to the respectively one of said lower stream pipes at a location diagonally above the central longitudinal axis of the respective one of said lower stream pipes as viewed in a plane perpendicular to said axis, at least a portion of an opening at which each of the upper stream pipes is open to the respective one of said lower stream pipes being located above said horizontal plane, and each of the upper stream pipes being inclined upwardly from the respective one of said lower stream pipes.

2. The vacuum sewage pipe network as claimed in claim 1, wherein 10% to 50% of said opening is located above said horizontal plane.

3. A vacuum-type sewage collecting apparatus for collecting sewage discharged from a plurality of houses or facilities, said apparatus comprises:

cesspools for accommodating sewage from the houses or facilities, respectively;

an accumulating tank for storing sewage;

an underground vacuum sewage pipe network connected between said cesspools and said accumulating tank for delivering sewage accommodated by said cesspools to said accumulating tank, said network including a plurality of lower stream pipes each including alternately disposed downwardly-sloping portions extending gently downwards towards said accumulating tank and lift portions extending with a steep upward slope from lowermost parts of said downwardly-sloping portions, respectively, wherein the lower stream pipes have a sawtooth-like shape, and a plurality of upper stream pipes branching from said lower stream pipes, each of the upper stream pipes extending from a respective one of said lower stream pipes within a range over which a horizontal plane, which extends through an upper portion of the respective one of said lower stream pipe at a location at which one of the downwardly-sloping portions thereof adjoins one of the lift portions, is higher than a central longitudinal axis of the respective one of said lower stream pipes, each of the upper stream pipes being open to the respective one of said lower stream pipes at a location diagonally above the central longitudinal axis of the respective one of said lower stream pipes as viewed in a plane perpendicular to said axis, at least a portion of an opening at which each of the upper stream pipes is open to the respective one of said lower stream pipes being located above said horizontal plane, and each of the upper stream pipes being inclined upwardly from the respective one of said lower stream pipes; and vacuum pump means operatively connected to said network for creating negative pressure within the pipes of said network.

4. A vacuum-type sewage collecting apparatus as claimed in claim 3, wherein 10% to 50% of said opening is located above said horizontal plane.

5. A vacuum-type sewage collecting apparatus as claimed in claim 4, wherein said network includes a lateral pipe connected directly to one of said cesspools, said lower stream pipes include a main pipe of the network connected directly to said accumulating tank, and said upper stream pipes include a branch pipe of the network connected to said main pipe to said lateral pipe.

6. A vacuum-type sewage collecting apparatus as claimed in claim 4, wherein said lower stream pipes include a main pipe of the network connected directly to said accumulating tank, and said upper stream pipes include a branch pipe connected to said main pipe and directly to one of the cesspools.

7. A vacuum-type sewage collecting apparatus as claimed in claim 4, wherein said network includes a main pipe connected directly to said accumulating tank, and a lateral pipe connected directly to one of said cesspools, said lower stream pipes include a first branch pipe of the network connected to said main pipe, and said upper stream pipes include a branch pipe connected to said first branch pipe and to said lateral pipe.

8. A vacuum-type sewage collecting apparatus as claimed in claim 4, wherein said network includes a main pipe directly connected to said accumulating tank, said lower stream pipes include a first branch pipe of the network connected to said main pipe, and said upper stream pipes include a lateral pipe connected to said first branch pipe and directly to one of the cesspools.

9. A vacuum-type sewage collecting apparatus as claimed in claim 3, wherein said network includes a lateral pipe connected directly to one of said cesspools, said lower stream pipes include a main pipe of the network connected directly to said accumulating tank, and said upper stream pipes include a branch pipe of the network connected to said main pipe and to said lateral pipe.

10. A vacuum-type sewage collecting apparatus as claimed in claim 3, wherein said lower stream pipes include a main pipe of the network connected directly to said accumulating tank, and said upper stream pipes include a branch pipe connected to said main pipe and directly to one of the cesspools.

11. A vacuum-type sewage collecting apparatus as claimed in claim 3, wherein said network includes a main pipe connected directly to said accumulating tank, and a lateral pipe connected directly to one of said cesspools, said lower stream pipes include a first branch pipe of the network connected to said main pipe, and said upper stream pipes include a branch pipe connected to said first branch pipe and to said lateral pipe.

12. A vacuum-type sewage collecting apparatus as claimed in claim 3, wherein said network includes a main pipe directly connected to said accumulating tank, said lower stream pipes include a first branch pipe of the network connected to said main pipe, and said upper stream pipes include a lateral pipe connected to said first branch pipe and directly to one of the cesspools.

* * * * *